US006763641B1

(12) United States Patent
Ahren et al.

(10) Patent No.: US 6,763,641 B1
(45) Date of Patent: Jul. 20, 2004

(54) GRIDLESS FREE FORM PLANK CEILING

(75) Inventors: Gregory M. Ahren, Lakewood, OH (US); John Bankston, Amherst, OH (US)

(73) Assignee: USG Interiors, Inc., Chicago, IL (US)

( * ) Notice: Subject to any disclaimer, the term of this patent is extended or adjusted under 35 U.S.C. 154(b) by 77 days.

(21) Appl. No.: 10/188,945

(22) Filed: Jul. 2, 2002

(51) Int. Cl.[7] ..... E04B 9/00

(52) U.S. Cl. ..... 52/506.06; 52/506.1; 52/520; 52/545

(58) Field of Search ..... 52/506.06, 506.07, 52/506.08, 506.09, 506.1, 509, 511, 512, 716.8, 718.01, 718.04, 520, 529, 545

(56) References Cited

U.S. PATENT DOCUMENTS

| | | | | |
|---|---|---|---|---|
| 2,099,211 | A | | 11/1937 | Lucius |
| 2,710,175 | A | | 6/1955 | Jorn |
| 3,004,141 | A | | 10/1961 | Waller et al. |
| 3,108,334 | A | | 10/1963 | Lindstrom |
| 3,131,794 | A | | 5/1964 | Bender |
| 3,276,171 | A | | 10/1966 | Brown |
| 3,354,595 | A | | 11/1967 | Abciuk |
| 3,733,767 | A | | 5/1973 | Craik |
| 3,981,116 | A | | 9/1976 | Reed |
| 4,109,437 | A | | 8/1978 | Player et al. |
| 4,192,117 | A | | 3/1980 | Heirich |
| 4,425,747 | A | | 1/1984 | Player |
| 4,744,188 | A | | 5/1988 | Ahren |
| 4,918,898 | A | | 4/1990 | McLeod, Jr. |
| 4,991,370 | A | * | 2/1991 | Gailey et al. ..... 52/506.1 |
| 5,134,825 | A | | 8/1992 | Berridge |
| 5,191,743 | A | | 3/1993 | Gailey |
| 5,195,289 | A | | 3/1993 | LaLonde et al. |
| 5,287,671 | A | | 2/1994 | Ueki |
| 5,799,461 | A | | 9/1998 | Dittemore |
| 5,937,605 | A | | 8/1999 | Wendt |

* cited by examiner

*Primary Examiner*—Carl D. Friedman
*Assistant Examiner*—Naoko Slack
(74) *Attorney, Agent, or Firm*—John M. Lorenzen; David F. Janci; Pearne & Gordon LLP

(57) ABSTRACT

A suspended ceiling island is constructed of sheet metal panels that since they are assembled without a supporting gridwork can be configured to create substantially any desired free form island shape. Typically, the panels have a pair of generally opposed straight sides and a pair of generally opposed free form sides. The straight sides, ideally, include upstanding flanges that are used to stiffen, interconnect and suspend the panels. Additionally, the flanges can be shaped into hollow sections similar to standard grid tee shapes to enable the use of standard hardware to attach trim strips to the perimeter of the island.

8 Claims, 7 Drawing Sheets

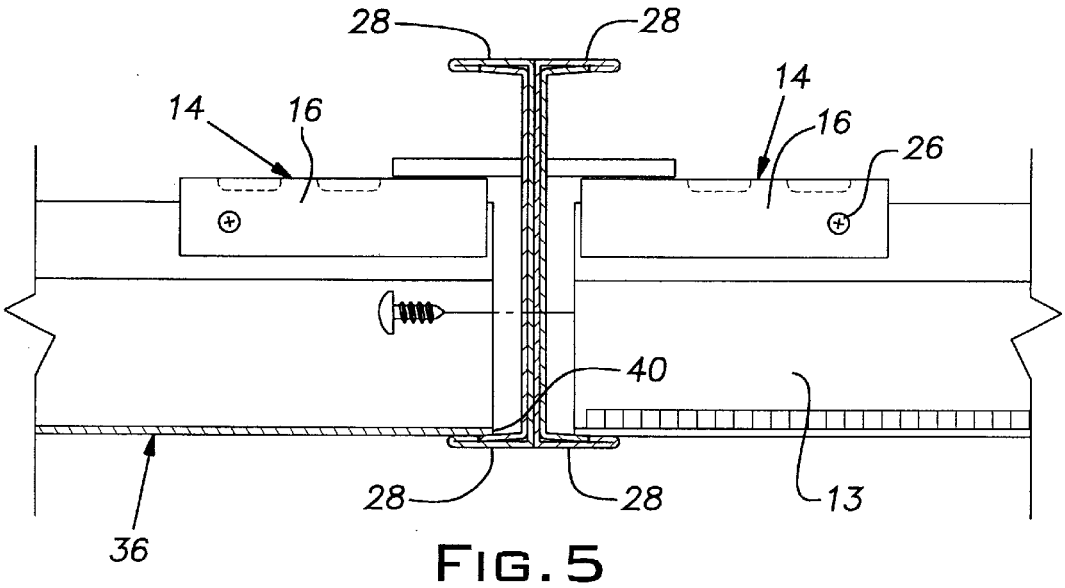
FIG. 5
FIG. 5A
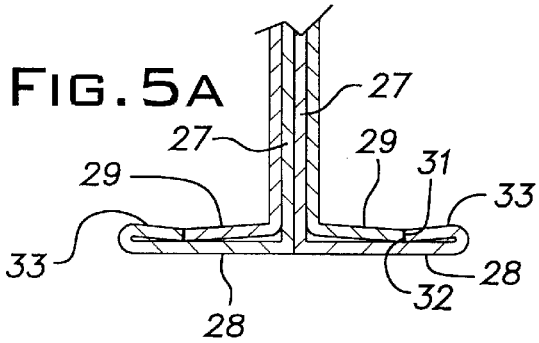
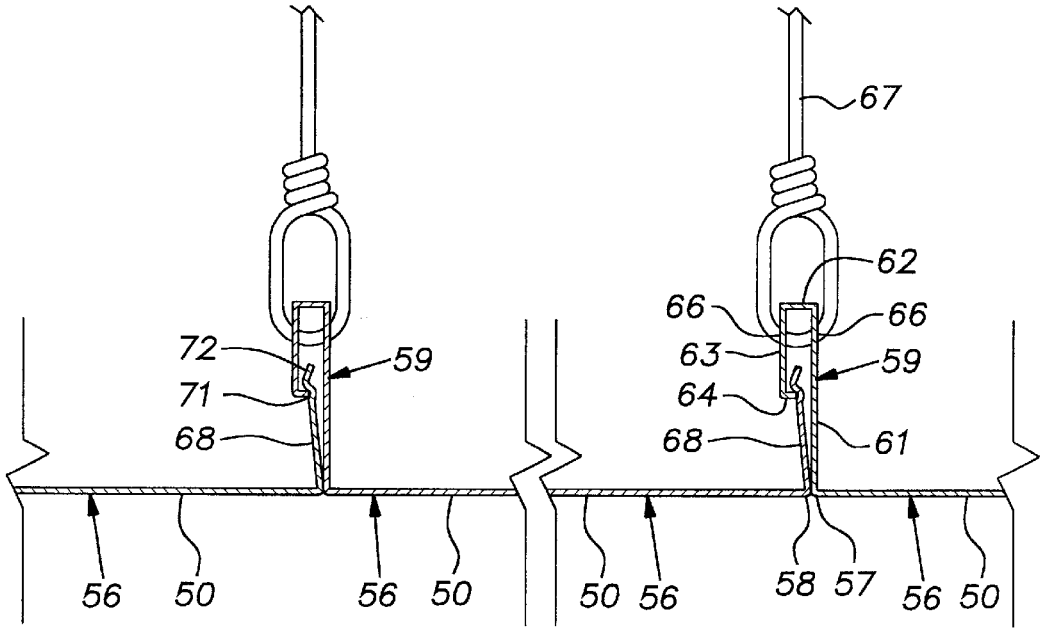
FIG. 6

FIG. 10
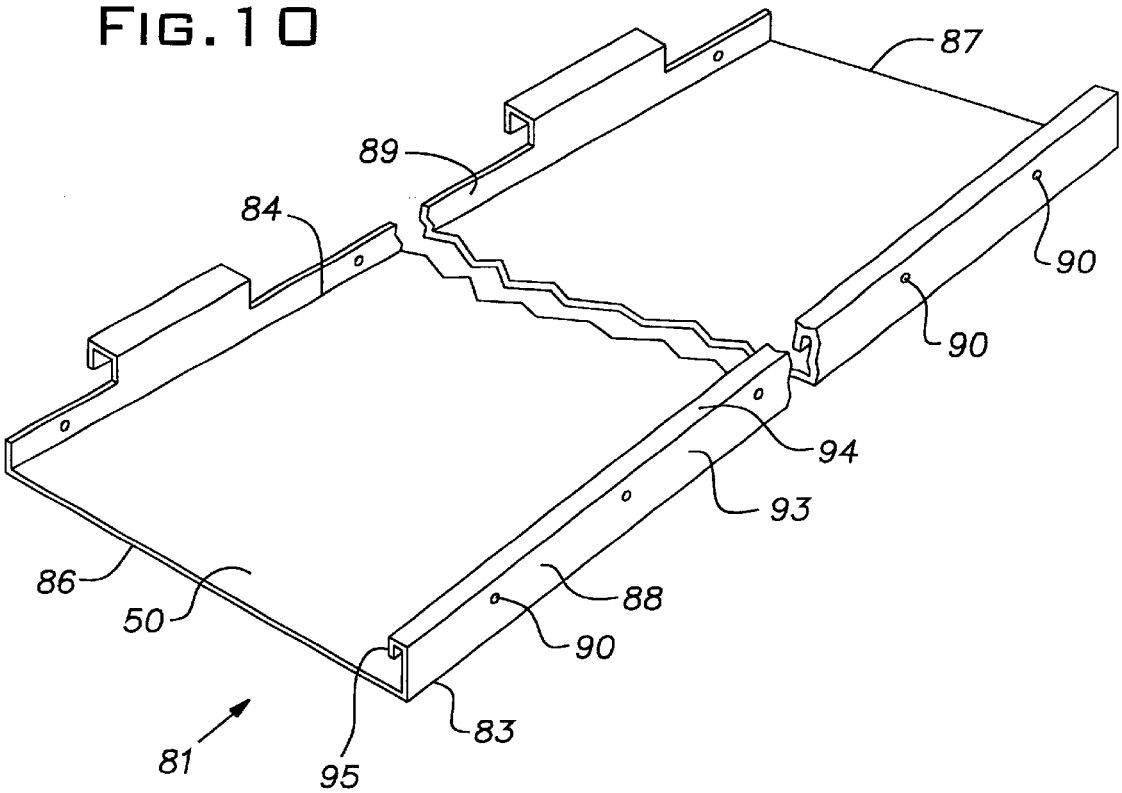
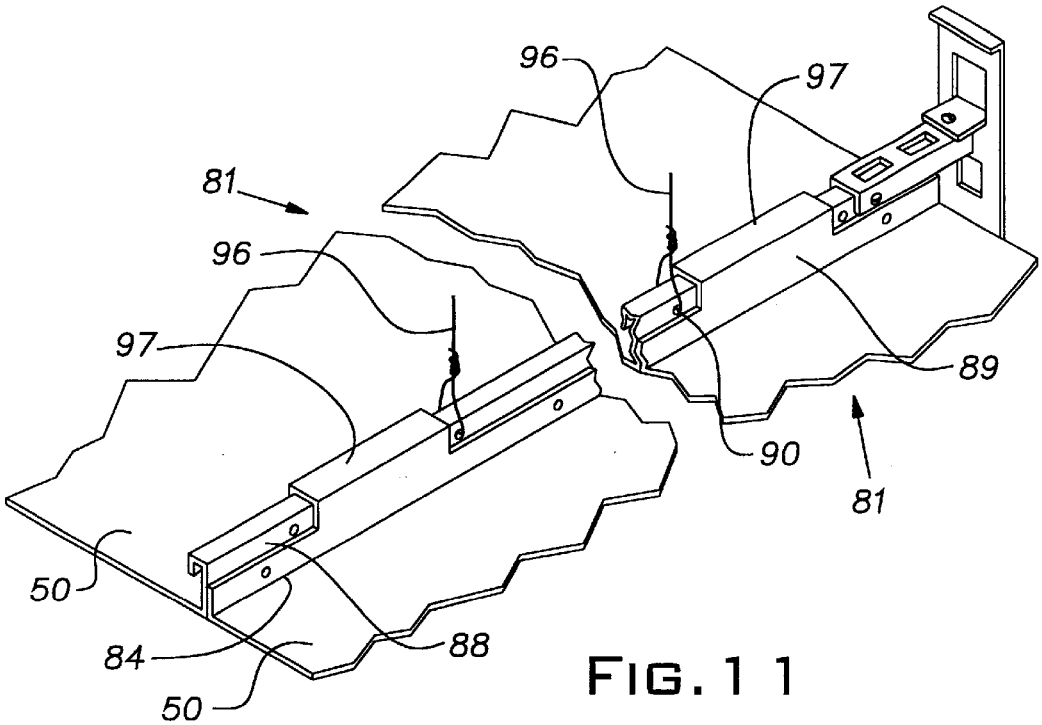
FIG. 11

GRIDLESS FREE FORM PLANK CEILING

BACKGROUND OF THE INVENTION

The invention relates to suspended ceiling construction and, in particular, to features of specialty suspended ceilings utilizing irregularly shaped metal panels.

PRIOR ART

U.S. Pat. Nos. 4,744,188 and 5,195,289 disclose suspended ceiling structures that are constructed as "islands" such that they are horizontally spaced from any surrounding walls and, often, are at a level or elevation different from other ceiling structure. These specialty ceilings are made available to allow architects and designers to create unique structures with dramatic visual effects not available with conventional plain rectangular grid suspension ceilings. These patents are directed to hardware for creating the perimeter of the island with pre-manufactured trim. Island ceilings constructed in accordance with these patents are typically limited to use of conventional rectangular or square grids with lay-in panels. The use of such grid within a non-rectangular island boundary can be difficult and time consuming to construct. Moreover, the limitation of using a rectangular grid can often result in a compromise over what an architect would prefer. It follows that there exists a need in the art, particularly in the area of suspended island ceilings, to enable the use of non-rectangular or non-standard rectangular panels or planks within the perimeter of the island to afford greater design freedom to the architect or designer.

SUMMARY OF THE INVENTION

The invention provides a ceiling construction, particularly suited for suspended island ceilings, in which individual panels collectively forming the expanse of the ceiling are of a configuration distinctive from conventional rectangular or square grid panels. The panels can thereby create a unique custom look to the ceiling. Moreover, where the perimeter or edges of the island ceiling are curvilinear, the individual ceiling panels in the perimeter areas can be configured to produce and/or compliment the desired curved form.

With the use of Autocad® or other computer-aided design programs and computer-aided manufacture, it is possible for an architect or designer to draw an island ceiling to his or her exact specifications on a computer and then use the computer drawing to instruct a sheet metal forming machining to create the panels of the present invention for the construction of the specified ceiling. The expanse of the ceiling, according to the invention, is divided into sections. The sections are formed by correspondingly shaped sheet metal panels or planks. In general, the planks are characterized by having two generally opposed straight sides and two generally opposed free-form sides, the latter being straight, concave, convex or any combination of these shapes. The straight sides of the panels have flanges that abut flanges of adjacent panels. Preferably, at least one of the abutting flanges has a hollow form adapted to mate with a special clip, such as disclosed in the aforementioned U.S. Pat. No. 5,195,289. The clips or mounting brackets are positioned on the ends or free form edges of the panel and connect with trim strips or channels. The clips are adapted to effectuate a connection with a trim strip in any of a broad range of intersection angles between the trim and the panel flange supporting the clip.

BRIEF DESCRIPTION OF THE DRAWINGS

FIG. 5 is a fragmentary elevational view, partially in section, of the island ceiling taken in the plane 5—5 indicated in FIG. 2;

FIG. 5*a* is an enlarged fragmentary cross-sectional view of a pair of abutting trim strips corresponding to the lower central area of FIG. 5;

FIG. 6 is a fragmentary cross-sectional view of a modified form of a ceiling panel constructed in accordance with the invention;

FIG. 10 is a perspective view of still another form of a ceiling panel constructed in accordance with the invention;

FIG. 11 is a fragmentary perspective view of the panel of FIG. 10, with a trim mounting clip attached thereto.

DESCRIPTION OF THE PREFERRED EMBODIMENTS

Figure 1:
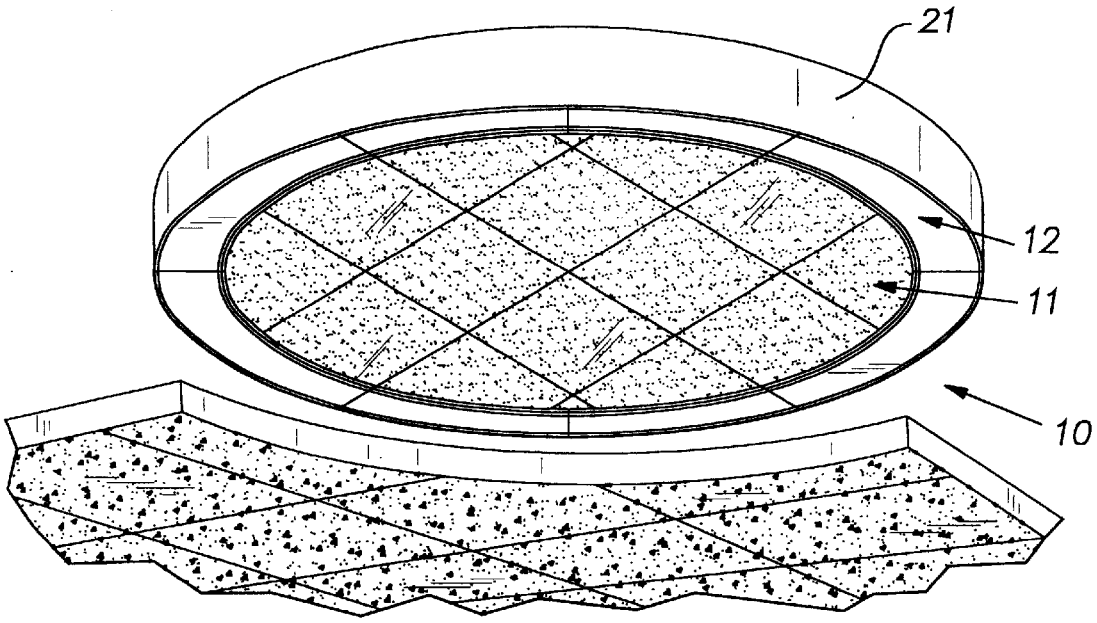
FIG. 1 is a perspective view of an island ceiling structure constructed in accordance with a first embodiment of the invention, a conventional suspended grid ceiling being shown fragmentarily in the background.
Figure 2:
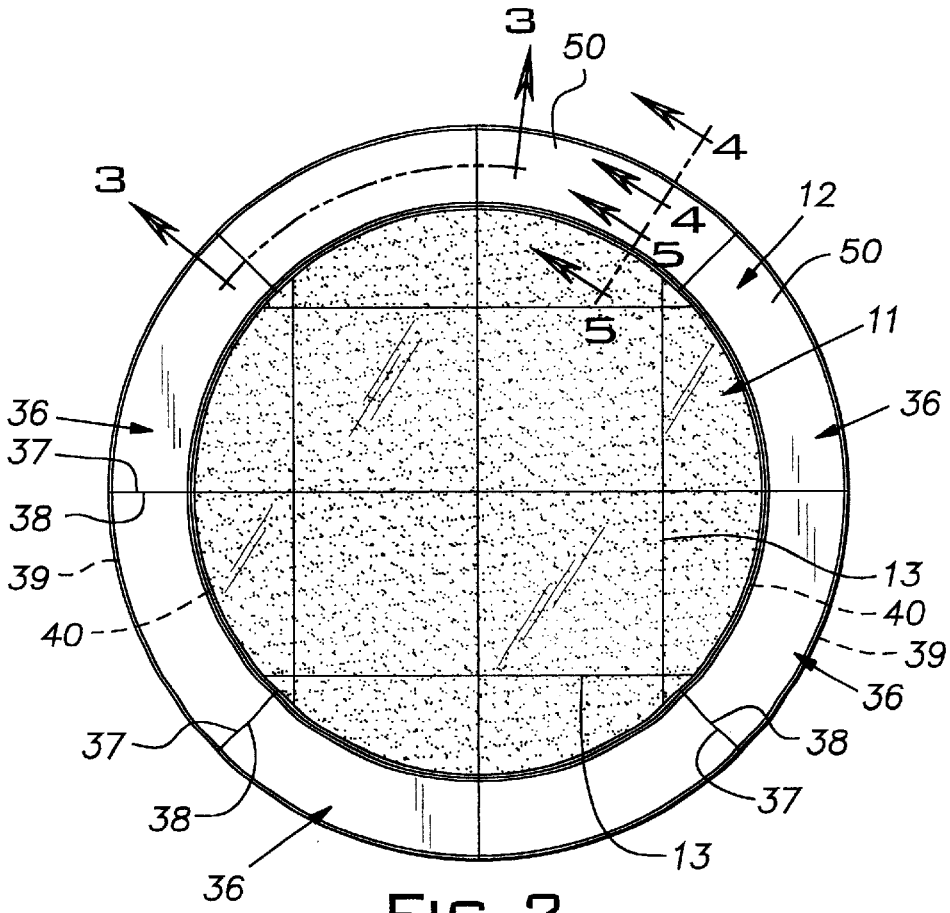
FIG. 2 is a reflected plan view (a view from the underside) of the island ceiling of FIG. 1.
Figure 3:
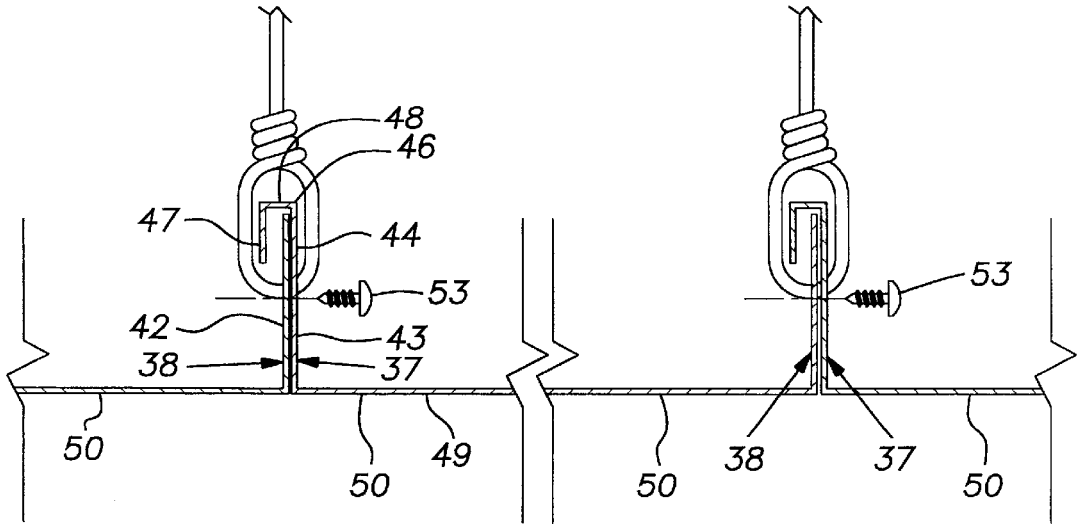
FIG. 3 is a fragmentary sectional view of a portion of the island ceiling taken along the lines 3—3 indicated in FIG. 2.
Figure 4:
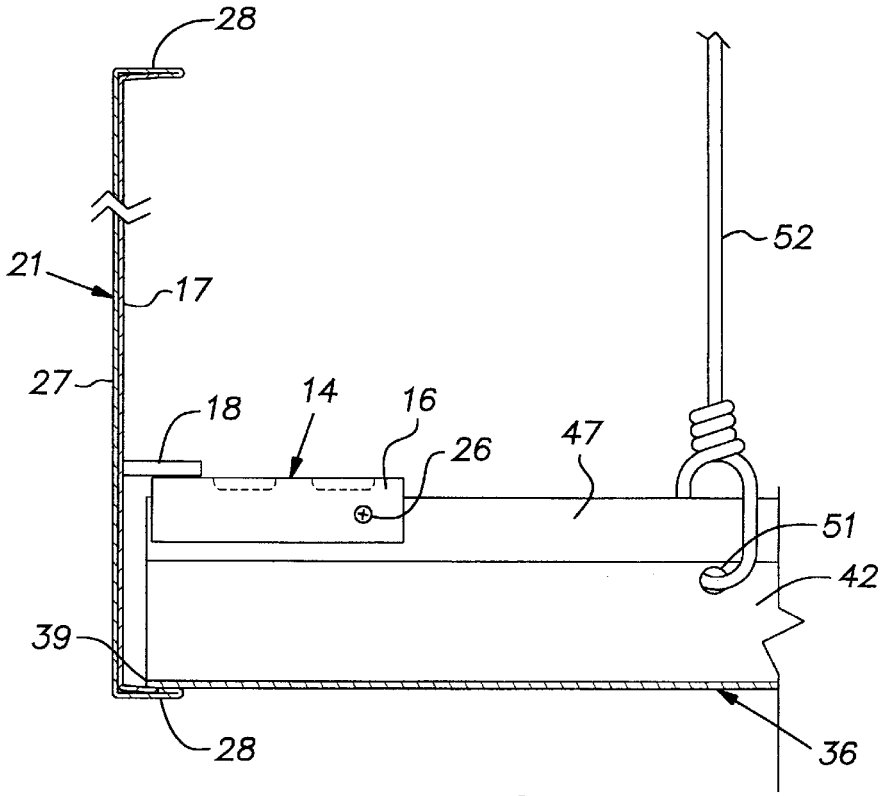
FIG. 4 is a fragmentary elevational view, partially in section, of the island ceiling taken along the lines 4—4 in FIG. 2.

Referring now to FIGS. 1–5, there is shown a first embodiment of the invention in the form of a suspended island ceiling 10. The illustrated island 10 is circular and comprises a central circular area 11 and an annular area 12 surrounding the central area. The central area 11 includes a grid made up of conventional suspended ceiling tees. Certain ones of the grid tees are cut short from their standard lengths of 2, 4 or 12 feet, for example, to fit within the circular area 11. A plurality of the cut ends of the grid tees 13 are fitted with clips or brackets 14 such as disclosed in aforementioned U.S. Pat. No. 5,195,289. The clips 14 are fabricated from sheet metal stock and include a U-shaped body 16 sized to snuggly fit over the bulb of a standard grid tee which is, typically ¼" wide. As shown, the body 16 in its normal installed orientation has its U-shape inverted and mounts in the manner of a paddle. The clip 14 also includes a trim mounting member or plate 17. A tab 18, stamped out of the plane of the mounting member 17 and bent to a perpendicular orientation, is pivotally mounted to the U-shaped body 16 by a rivet 19. Pivotal movement about the rivet 19 allows the mounting member 17 to align in tangency with a trim strip or channel 21 of a type, for example, disclosed in aforementioned U.S. Pat. No. 5,195,289. Such trim strips 21 are arranged front-to-front as shown in FIG. 5 and discussed below. In FIG. 4, the clip 14 has a vertically extended mounting member 17 to accommodate a relatively wide (in the vertical direction) trim strip 21. Sheet metal screws 26 are used to retain the brackets 14 in place on the ceiling structure to be described.

With reference to FIG. 5, a conventional grid tee 13 is shown at the right. A bracket or clip 14 assembled and retained on the tee by the screw 26 carries a convex channel-shaped trim strip 21. The trim channel 21 includes a vertical wall 27 (which is curved in a horizontal plane in the various embodiments disclosed herein) and a pair of horizontally extending flanges 28. The same numerals are used to designate like parts in the taller trim strip 21 of FIG. 4. For purposes of this disclosure, the trim strip 21 is convex where its radius of curvature is on the side of the wall 27 where the flanges 28 exist and is concave where its radius of curvature is on the side of the wall remote from where the flanges exist. The trim mounting member 17 includes a pair of reverse or inwardly bent tabs or flanges 29 at its upper and lower ends which are adapted to push into the space between the trim strip flanges 28 such that edges 31 of these tabs 29 snap behind edges 32 of in-turned hems 33 on the trim strip flanges 28 thereby effectuating a concealed connection between the trim strip 21 and bracket 14 as well as the ceiling structures to which the bracket body 16 is attached.

More specifically, the central area 11 of the island ceiling 10 is bounded by a circular arrangement of arcuate convex segments of the trim strip 21. These segments of trim strip 21 are carried on the grid tees 13 by a plurality of the clips 14 distributed about the periphery of the circular area 11 and connected to such segments of trim strip by the snap-in process described above. It will be appreciated that the angular adjustability of the bracket mounting member 17 allows this assembly to be accomplished regardless of the angle at which the trim strip and grid tee intersect.

The foregoing description is an example of the application of the prior art disclosed in aforementioned U.S. Pat. No. 5,195,289. The present invention involves the construction of a suspended ceiling island or part thereof which is comprised of a plurality of sheet metal panels and, for the present purposes, can be described as "gridless"In the embodiment of FIGS. 1–5, the sheet metal panels are designated by the numeral 36. These panels 36 form the annular area 12 and are arranged in but one example of the versatility of the invention. As will be understood, the panels of the invention can provide an infinite number of island designs with or without integration with other kinds of ceiling systems.

Figure 9:
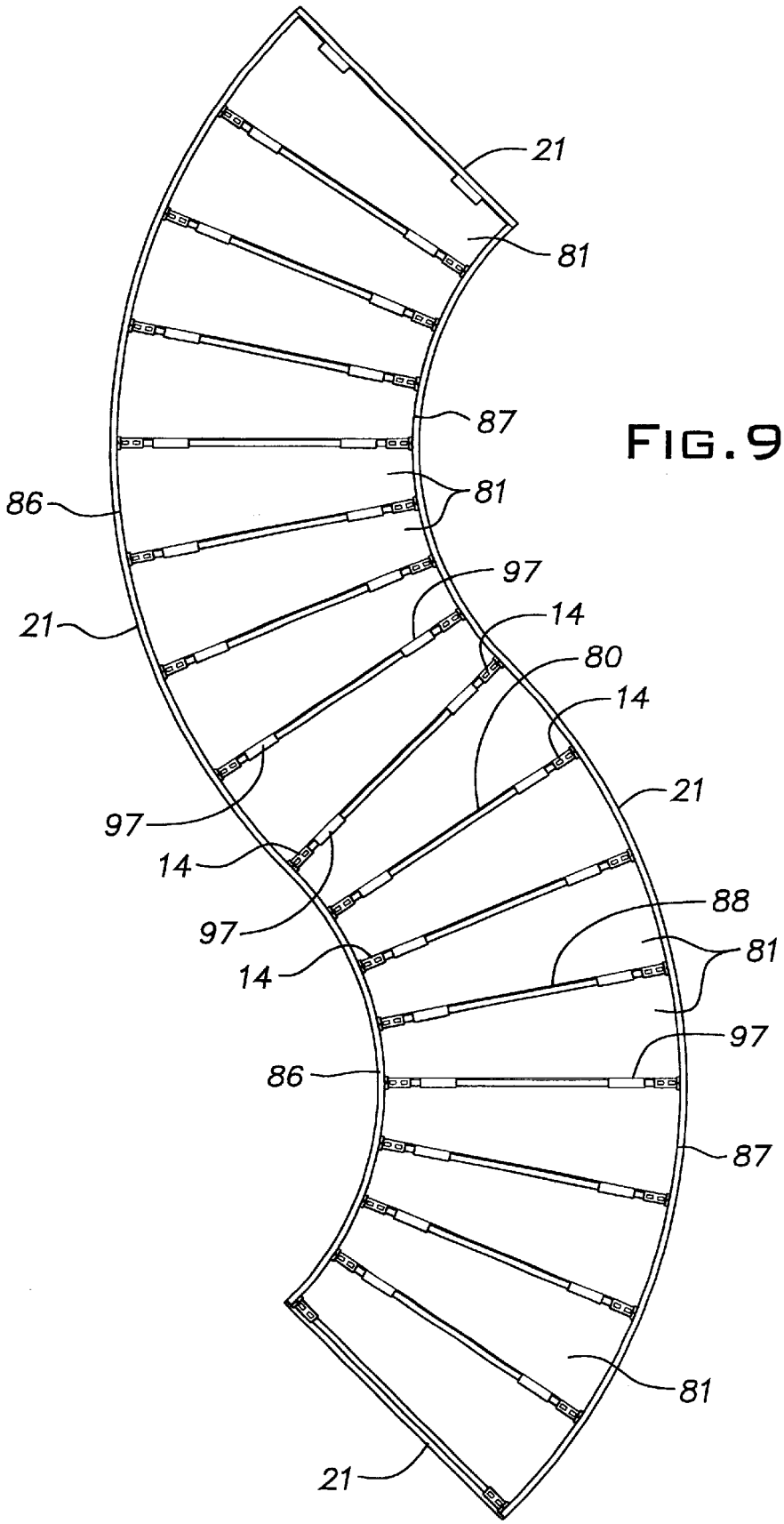
FIG. 9 is a plan view of an elongated free-form suspended ceiling island constructed in accordance with the invention.
Figure 12:
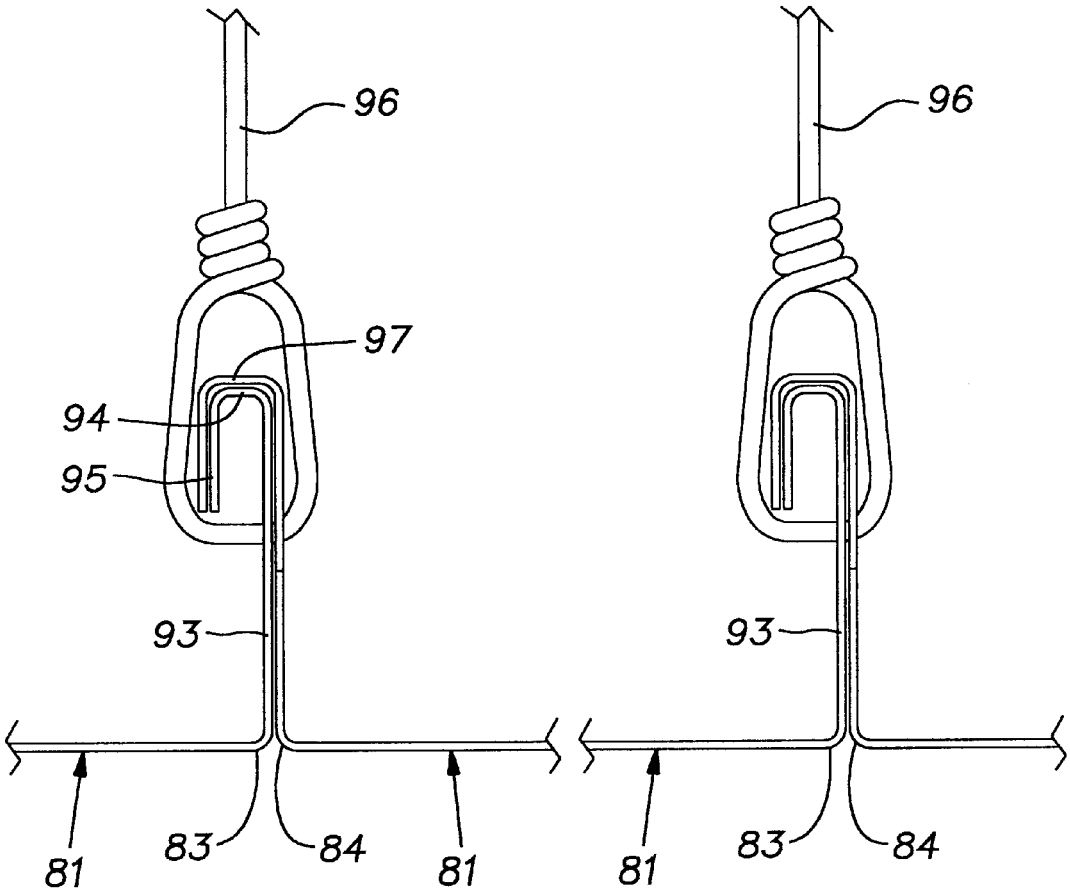
FIG. 12 is a fragmentary sectional view taken in a vertical plane through portions of several ceiling panels like those illustrated in FIG. 10.

The panels 36 are preferably fabricated from sheet metal such as steel or aluminum and are characterized by generally opposed straight sides 37, 38 and generally opposed free form sides 39, 40. In the illustrated case of FIGS. 1–5, the free form sides 39, 40 are circular arcs that are concentric with one another; however, it will be apparent from the discussion below with respect to FIG. 9 and from an understanding of the invention, that the free form sides 39, 40 can take any desired shape including straight, convex, concave and combinations of any of these shapes. The straight sides 37, 38 of the panels 36 are shown in cross-section in FIG. 3. One side 38 includes a straight upstanding flange 42 while the other side 37 has a J-shaped flange 43. More specifically, the J-shaped flange 43 comprises an upstanding main flange wall 44, a horizontal web 46 and a depending minor flange wall 47. The walls 44, 47 and web 46 create a hollow analogous to the hollow of a reinforcing bulb of a conventional grid tee. Importantly, the dimensions of the J-shaped flange 43, namely the height of an upper surface 48 of the web above a lower face 49 of the panel 36 is nominally 2.5", the same as the height of a bulb of a grid tee and the width across the outer faces of the flange walls 44, 46 is 0.25", the same as the typical width of a bulb of a grid tee. This enables the use of a standard clip or bracket 14 that can be used both with conventional grid tees and with the ceiling panels of the present invention. The brackets 14 can be attached and fixed with screws 26 to one or both ends of the J-flange 43 at the free form sides 39, 40 as needed.

As depicted in FIG. 3, the panels are joined by assembling the flange 38 into the hollow of the flange 37; this can be done by either hooking the flange 37 over the upper edge of the flange 38 or by slipping the flange 38 into the hollow. The flanges 37, 38 have aligned holes 51 to receive suspension wires 52 to support the panels 36 from a superstructure as is known in the art. The flanges 37, 38 are abutted with the lower panel faces 49 coplanar and can be held in this position by sheet metal screws 53. Ordinarily in this and other embodiments a panel is assembled with adjacent panels by laterally aligning the adjacent straight side flanges lengthwise with each other.

With reference to FIG. 5, arcuate lengths of concave trim strip or channel 21 is abutted in face-to-face relation to the convex trim strip 21 joined to the grid tees 13 of the central circular area 11. The panels 36 are joined to the concave trim channels 21 by snapping the attached brackets 14 into this trim. Similarly, the convex trim 21 on the outer periphery of the annular area 12 is mounted to the panels 36 by snapping the clips 14 attached on the radially outward ends of the J-channels 43 into the trim as suggested in FIG. 4.

FIG. 6 illustrates, in cross-section, a modification of a ceiling panel in accordance with the invention. In this modification, a panel 56 has two generally opposed straight sides 57, 58 and two generally opposed free-form sides as described before in connection with the panel 36. The straight side 57 has a flange 59 with an inverted G-shaped hollow cross-section. The G-shape or form is comprised of a generally vertical main flange wall 61, a horizontal web 62, a depending minor flange wall 63 and a horizontal in-turned lip 64. The flange walls 61, 63 have aligned holes 66 for receiving suspension wires 67. The opposed straight side 58 of the panel 56 has an upstanding flange 68 which may be over bent to an included angle of slightly less than 90° from the main part of the panel 50. The flange 68 is sufficiently tall to extend into the space or hollow of the channel-like area between the flanges 61, 63 of an abutting panel 56. The upper free edge of the flange 68 is bent along the lines parallel to the main part or panel proper 50 to form a detent groove 71 and a leading cam surface 72. The cam surface 72 facilitates insertion of its associated flange 68 into the channel of the adjacent panel flange. The over square bend of the flange 68 and the other related geometry of the panel 56 allows the detent groove to interconnect with the adjacent panel 56 and support its associated panel from this adjacent panel, the latter being carried by the suspension wires 67. The channel formed by the flange walls 61 and 63 and web 62 has a width and height above the lower panel face 49 corresponding to a standard grid tee bulb height and width as explained above so that a standard clip 14 can be used as described.

Figure 7:
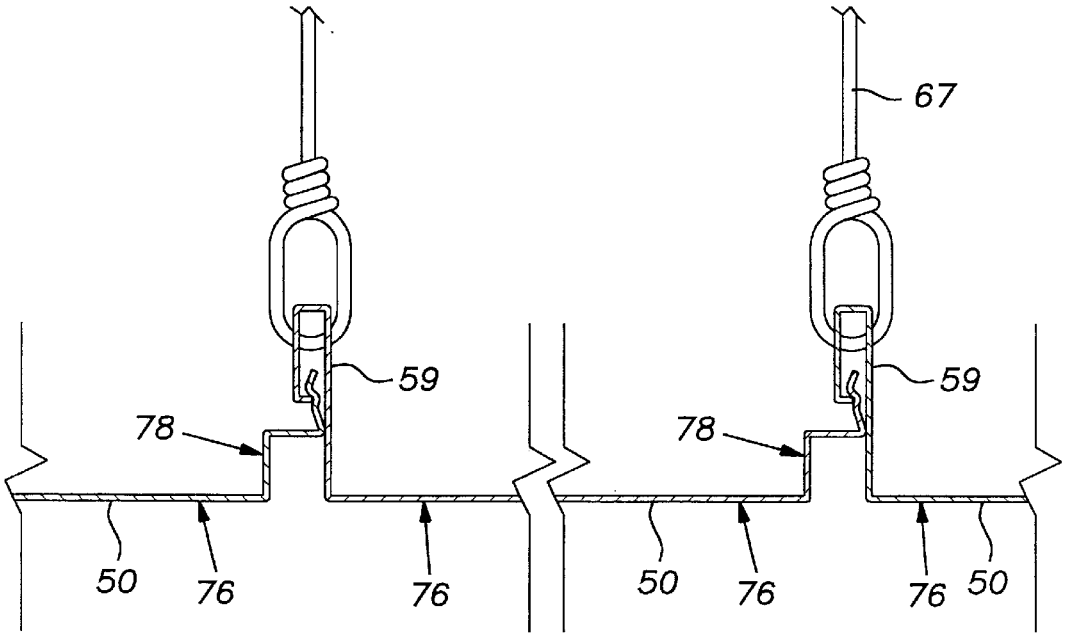
FIG. 7 is a fragmentary cross-sectional view of another modified form of the ceiling panel of the invention.
Figure 8:
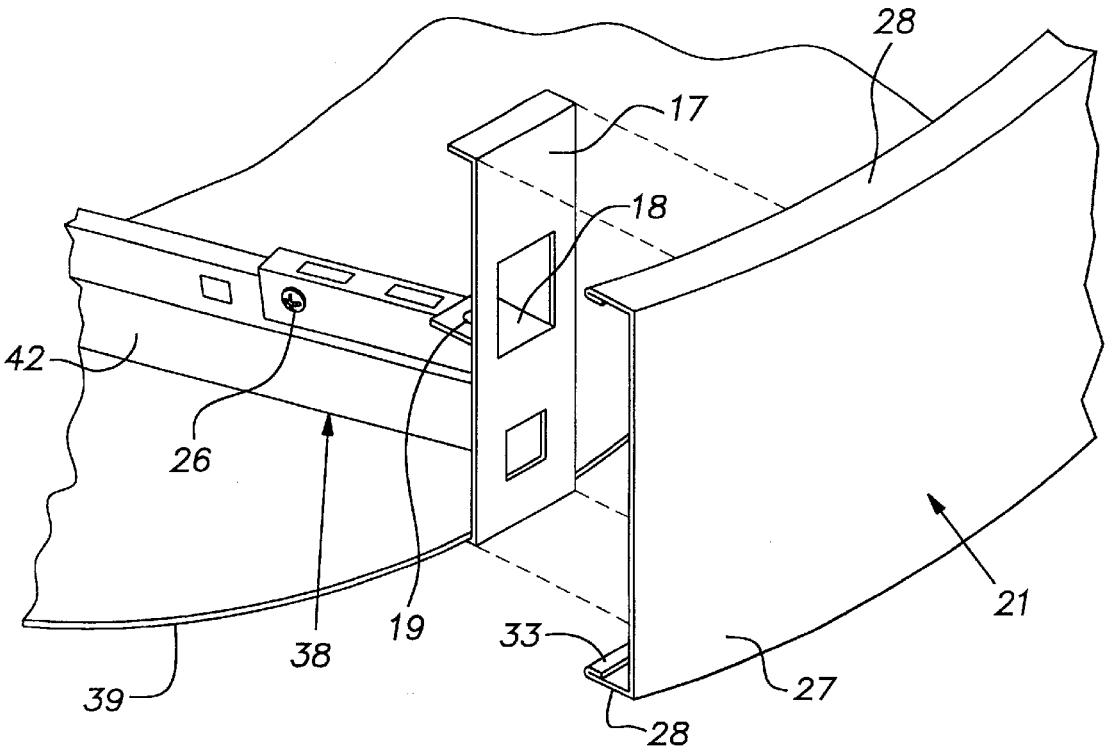
FIG. 8 is a fragmentary perspective view of a ceiling panel, trim mounting clip and perimeter trim, partially exploded.

FIG. 7 illustrates a cross-sectional view of a set of panels 76 similar to those of FIG. 6. The same reference numerals are used as in FIG. 6 to identify like elements. In this modification, a straight panel side 77, corresponding to the straight side 58 of the panel 56 in FIG. 6, has a stepped flange 78 rather than the generally straight flange 68 of the panel 56 of FIG. 6. The stepped flange 78 gives the appearance in the finished ceiling greater visual detail than the panel of FIG. 6 but is otherwise the same in function.

FIGS. 9–12 illustrate another embodiment of the ceiling panels or planks 81. As in the previous embodiments, the panels 81 are formed of sheet metal and each has a main part or a panel proper 50 that is generally planar or flat. Each panel 81 has two generally opposed straight edges or sides 83, 84 and two generally opposed free form edges or sides 86, 87. The straight edges have upstanding flanges 88, 89 while free form edges 86, 87 typically, but not necessarily, are simply cut or trimmed in the plane of the panel and are devoid of any flange or hem. One flange 88, has an inverted J-shape formed by a generally vertical main flange wall 93, a horizontal web 94, and a depending minor flange wall 95. As in previously described embodiments, the channel of the flange formed by the walls 93, 95 and web 94 conform to standard tee grid geometry, with a height above a lower face 49 of the panel proper 50 and a width of ¼". Holes 90 are spaced along the main flange wall 93 below a lower edge of the minor wall 95, to receive suspension wires 96.

For most of its length, the flange 89 on the panel side 84 opposed to the flange 88 is a simple upturned wall. Spaced inwardly from its ends, the flange 89 has integral J-hooks 97 dimensioned to fit snuggly over the channel-shape of the J-flange 88. As shown in FIG. 11, the spacing of the hooks 97 from the respective ends of their flanges 89, or the proximate free form side, 86 or 87 of the panel 81 exceeds the length of the clips 14. This ensures that there is no interference between a clip 14 and the flange hooks 97. The height of the main length of the flange 89 is such that its upper edge does not interfere with suspension wires 96 threaded through the holes 90 in an abutting flange wall 93.

The construction of the panel 81 enables a ceiling to be progressively erected in a relatively simple manner since the second and subsequent panels can be readily hung on the preceding panel by positioning its hooks 97 over the J-flange 88 of the preceding panel 81 while the latter is suspended by wires 96. Clips 14 are positioned on the ends of the flanges 88 of some or all of the panels 81 to enable installation of desired face trim 21 of the type previously described.

The panels of the various embodiments are described as having generally planar or flat main portions or faces. It will be understood that this characterization includes main panel portions that are textured, apertured, corrugated or similarly treated for visual and/or functional reasons. In the illustrated examples, the panels are fabricated of one piece of sheet metal, such as steel or aluminum, and are stamped and/or bent into their respective configurations from flat or roll sheet stock. It will also be understood that the flanges of the generally opposed straight sides serve to stiffen the panels in addition to providing for interconnection of panels and trim and for suspension of the panels. In general, the straight sides of the panels are non-parallel where an overall free form island ceiling is specified. In the illustrated embodiments, the free form sides overlie the flange elements of the trim strips or channels to enable the trim strips to support these sides against excessive sagging.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A suspended ceiling comprising a plurality of sheet metal panels, the panels having main parts that are generally flat, a pair of generally opposed straight sides and a pair of generally opposed free form sides, the panels being arranged with their main parts in a common plane and forming an array in which a plurality of the panels have each of their straight sides in abutting contact and in general lateral alignment with a straight side of an adjacent panel, each of said straight sides having a generally upwardly extending flange formed by bending the stock from which the panel is made, one of the flanges on each of the panels being shaped into a hollow formation along an upper edge of the flange distal from the main part of the panel, a plurality of brackets attached to the flanges adjacent the free form sides, a trim strip attached to said brackets, said brackets each having a body portion attached in the manner of a saddle over a hollow formation of a respective flange.

2. A suspended ceiling as set forth in claim 1, wherein said brackets each have a face pivotally connected to the saddle body portion to mate with a trim strip that crosses a line defined by the straight panel side associated with the hollow flange on which the bracket is mounted at an angle other than 90°.

3. A suspended ceiling as set forth in claim 1, wherein the flange on the side opposite the side having said hollow flange has integral hook areas arranged to hook over the hollow flange of an adjacent panel to enable its panel to be at least partially supported by said adjacent panel.

4. A suspended ceiling as set forth in claim 3, wherein the hook areas are spaced from the free form sides of their respective panels a distance sufficient to avoid interference with said brackets.

5. A suspended ceiling as set forth in claim 1, wherein the flanges of straight sides opposed to the sides having said hollow flanges are adapted to be received in the hollow flanges of adjacent panels.

6. A suspended ceiling as set forth in claim 5, wherein the flanges of the straight sides opposed to the sides having said hollow flanges are adapted to inter-engage with the hollow flanges in a manner allowing the panels to be at least partially supported by such inter-engagement.

7. A suspended ceiling comprising a plurality of sheet metal panels arranged in a non-rectangular array and in a common plane, the panels having a pair of generally opposed straight sides and a pair of generally opposed free form sides, the straight sides being formed with integral flanges bent upwardly from a planar main part of the respective panel, one of the flanges of each of the panels being bent into a hollow form a predetermined distance above the respective panel main part, the hollow form flanges of at least some of the panels each being interconnected to a flange of an adjacent panel that is opposed to the hollow flange of such adjacent panel, a bracket having a U-shape body secured in the manner of a saddle to the hollow flange of at least some of the panels, each bracket having a connector element joined to the body at a joint that permits pivoting of the connector element relative to the body about a vertical axis, a trim strip connected by said connectors to said panels, said trim strip having a horizontally extending flange arranged to underlie the free form sides and resist sagging of such sides.

8. A suspended non-rectangular island ceiling comprising a plurality of sheet metal panels arranged in a non-rectangular array and in a common plane, the panels having a pair of generally opposed straight sides and a pair of generally opposed free form sides, the straight sides being deliberately formed in non-parallel relation to one another, the straight sides being formed with integral flanges bent upwardly from a planar main part of the respective panel, one of the flanges of each of the panels being bent into a hollow form a predetermined distance above the respective panel main part, the hollow form flanges of at least some of the panels each being interconnected to a flange of an adjacent panel that is opposed to the hollow flange of such adjacent panel, the integral flanges of the panels providing sufficient rigidity to the panels to enable the panels to be suspended through the flanges by overhead wires connected to the flanges while being free of additional structural support, a separate bracket body secured to the flange of at least some of the panels, each bracket having a connector element joined to the body at a joint that permits pivoting of the connector element relative to the body about a vertical axis, a trim strip connected by said connectors to said panels, said trim strip having a horizontally extending flange arranged to underlie the free form sides and resist sagging of such sides, the trim strip forming at least a portion of the perimeter of the island ceiling.

* * * * *